US005247984A

United States Patent [19]

Stanciu

[11] Patent Number: 5,247,984

[45] Date of Patent: Sep. 28, 1993

[54] PROCESS TO PREPARE A PATTERN FOR METAL CASTINGS

[75] Inventor: Virgil V. Stanciu, Rocky River, Ohio

[73] Assignee: Howmet Corporation, Greenwich, Conn.

[21] Appl. No.: 705,382

[22] Filed: May 24, 1991

[51] Int. Cl.[5] ..... B22C 7/02; B22C 9/04

[52] U.S. Cl. ..... 164/35; 164/45

[58] Field of Search ..... 164/45, 34, 35, 36

[56] References Cited

U.S. PATENT DOCUMENTS

| | | | |
|---|---|---|---|
| 2,420,851 | 5/1947 | Zahn et al. | 164/35 |
| 3,063,113 | 11/1962 | Operhall et al. | 164/45 |
| 3,601,178 | 8/1971 | Marticorena | 164/45 |
| 3,838,728 | 10/1974 | Voegele | 164/45 |
| 3,982,934 | 9/1976 | Wentzell | 164/45 X |
| 4,682,643 | 7/1987 | Bernhardt et al. | 164/45 X |

FOREIGN PATENT DOCUMENTS

| | | | |
|---|---|---|---|
| 43-24162 | 10/1968 | Japan | 164/45 |

*Primary Examiner*—J. Reed Batten, Jr.
*Attorney, Agent, or Firm*—Oldham, Oldham & Wilson

[57] ABSTRACT

A plastic model pattern indicative of the desired completed pattern having prescribed dimensional tolerances and surface finish characteristics is encased within a Type I material which may be a soluble wax or low melting point material, and subsequently leached from the Type I material to define a cavity corresponding to the dimensional characteristics of the plastic model pattern. A Type II material, such as an insoluble wax or high melting point material, may then be injected into the cavity to recreate the plastic model pattern without the use of any plastics materials, to avoid potentially mold deteriorating expansion of such plastics materials. The mold form of Type I material may then be removed by leaching, melting or the like to reveal the completed expendable pattern usable in a lost wax mold forming process. An injection apparatus and die structure is advantageously utilized in conjunction with the process to achieve high production quality and insure proper formation of the expendable pattern. The process and apparatus allows for the advantageous use of plastic models, while eliminating the deficiencies thereof in a cost effective and novel process.

14 Claims, 4 Drawing Sheets

PROCESS TO PREPARE A PATTERN FOR METAL CASTINGS

FIELD OF THE INVENTION

This invention relates to a process and apparatus to form a mold pattern usable in the field of investment casting or other mold forming process. More particularly, the invention pertains to the process for making an expendable pattern usable for forming a mold for the casting of complex and precise metal objects, and an apparatus which enables the pattern to be formed. The method takes advantage of the use of plastic materials in the pattern which have many benefits, and eliminates the deficiencies thereof. The process will greatly reduce mold spoilage and allow high precision and integrity of the mold pattern to be achieved.

BACKGROUND OF THE INVENTION

In the production of precision metal objects, expendable patterns are many times utilized to generate mold forms usable in metal casting processes. The molds are formed about an expendable pattern, whereby the pattern can be disposed of after formation of the mold to generate a cavity into which a molten metal may be poured, thereby producing the metal castings. The metal castings are often intricate in their geometry and require great precision in characteristics such as dimension and surface finish so as to be acceptable for their intended use. The processes generally used for producing precision metal objects from expendable patterns are investment casting techniques.

In the investment casting process, a ceramic shell is formed about an expendable pattern by coating of the pattern with a ceramic dip coat composition. After coating, the wetted surface of the pattern may be covered by a stucco coat of ceramic particles and air dried, after which a number of similar dip coats and stucco coats may be similarly applied until a shell of sufficient thickness and strength has been formed about the expendable pattern. Once the mold form is fabricated in this manner, the expendable pattern is removed, leaving the mold form and cavity which may then be used in a metal casting process.

Another process has been termed the mono-shell process, which includes the steps of building up a shell by alternate dip and stucco coats, wherein the formed shell is then given a final coat of a dip coat composition containing an eutectic material having a lower maturing temperature than the ceramic materials in the stucco or dip coats. Upon subsequent heating of the composite shell structure to a high temperature for removal of the expendable pattern, the eutectic material is made to flow inwardly into the mold form for better sealing thereof which helps to eliminate fracturing or other affects caused by the elevated temperatures used to remove the expendable pattern. The mold form generated in this process will have a greater strength to allow handling in the casting process without additional steps being necessary to strengthen the mold form.

In the investment casting process, an expendable pattern is also utilized, and may be coated with built-up layers of dip coat and stucco in a manner similar to that previously described. The mold form generated in this manner may then be invested within a matrix of ceramic material to provide additional support for the mold form to allow handling without deterioration thereof. Alternatively, an expendable pattern may be covered with a suitable investment material such as a ceramic, which is then permitted to solidify to generate the desired mold form having intricate geometry and great precision as required. In the investment process, the expendable pattern or a composite pattern and the mold shell formed therearound may be mounted within an enclosure and exposed to a composition of a ceramic material which will set up and form a rigid exterior about the expendable pattern or composite mold form. The ceramic material may then be heated for a predetermined amount of time in a heating cycle to fire the ceramic investment material of the mold form. For use of the mold form for casting of metal objects, the expendable pattern material may then be removed. Conventionally, during the heating cycle, the expendable pattern is removed either by being reduced to a molten state so as to flow from the mold form or by burning the expendable pattern material when heated to the temperature of combustion, or both. The mold form will then comprise the investment as a matrix, and an inner lining of the built-up layers formed of the dip coat and stucco materials, which is then available for casting of the precision metal pieces.

In the above mentioned processes used for producing precision metal objects by metal casting techniques, the expendable or sacrificial mold patterns are conventionally comprised of low melting point waxes, which when heated to a sufficient degree will be reduced to a flowable state for removal from the formed mold. In many situations, long term, low temperature melt-out cycles are utilized in an effort to minimize fracturing of the mold which may result from more radical temperature variations or the exposure of the mold form to higher temperatures. It should be recognized that if the material used in the expendable pattern is heated to the degree of combustion, expansion of the materials upon combustion may also result in mold spoilage by deformation of the precise geometrical characteristics and dimensions required in the mold or fracturing thereof. It has been found that the use of low melting point waxes utilized in the fabrication of large mold patterns are unsuitable in many respects as the material may deform either during the fabrication of the patterns or handling thereof subsequent to fabrication, and be extremely expensive to hand fabricate. The special problems frequently encountered when attempting to produce large precision parts by the lost wax casting processes generally stem from the inadequacies of the materials and/or processes used to form the expendable or sacrificial mold patterns. Attempts to overcome the deficiencies of using fabricated low melting point waxes as the pattern materials have included the use of more structurally competent plastic materials has been attempted. Such plastic materials are advantageous in that the structural integrity is maintained during fabrication and handling as the materials are not readily deformable, and such plastic materials may be formed into a variety of complex geometries with great precision as required. The use of plastic materials in the preparation of expendable patterns also allow the fabricated pattern to be composed of a plurality of plastic parts which may be coupled to one another to generate the final pattern. For many metal castings which are intricate in their geometry and require great precision as to dimension and surface finish, the use of such plastic materials may also simplify the fabrication of the mold pattern. For complex expendable mold patterns, such as, for instance, a turbine wheel be constructed of a soluble or low melting point wax injected into a suitable mold configured for the individual segments or portions thereof. These individual wax segments may be fused together in more elaborate assembly fixtures, requiring labor intensive activities instances, a wax material handled in this manner will become deformed, and the elaborate assembly components for complex castings may be deficient in their capacity to form a complex and precision casting with acceptable tolerance specifications. The use of plastic patterns overcome some of the disadvantages with respect to the fabricated low melting point waxes and allow the construction of extremely complex patterns in a straightforward manner without the possibility of pattern spoilage by means of deformation or fracturing during handling thereof.

Although expendable patterns utilizing plastic materials overcome some of the disadvantages of the fabricated low melting point waxes, a major deficiency in the use of such plastics is found in the potential inability to remove the plastic pattern from the mold form easily and effectively without incurring mold spoilage. It has been found that the application of heat in an attempt to remove such plastic patterns may result in significant expansion of the plastic materials within the mold cavity resulting from the change from solid to vapor in a very short period of time, rendering the use thereof unsuitable for most lost wax casting processes. The problem is manifested in the propensity of the plastic material, when subjected to heat, to change from the solid state to the gaseous state in a very short period of time, which results in expansion of the materials within the mold cavity, and which in turn will normally fracture or otherwise damage the mold form. Although the application of heat during a heating cycle can reduce such plastic materials to a molten state so as to flow from the mold cavity, the range of temperatures at which the plastic material becomes molten or liquified is extremely small, and the heating cycle must be controlled with great accuracy to avoid the thermal reaction which makes the use of such plastic materials difficult and operationally complex.

Another attempt to avoid the inherent disadvantages of the use of low melting point waxes in the fabrication of expendable patterns for metal casting techniques, especially with respect to large or particularly intricate patterns, is shown in U.S. Pat. No. 3,063,113. In this prior patent, the problems described above with respect to pattern materials having the potential for expansion within the mold cavity or deformation due to inadequate structural integrity, were stated to be overcome by fabricating the expendable pattern from a combination of a base pattern preferably formed of a plastic material, having a thin coating on its surface of another material which had a melting point below the temperature at which significant deformational changes due to expansion would take place in the base material. In such a construction, the thickness of the coating material such as a lower melting point wax, was chosen based upon the amount of expansion expected in the base plastic material. During the heating cycle, the low melting point material will expand minimally before becoming molten thus not creating any forces which are detrimental to the mold, and will flow from the mold cavity to leave sufficient space between the mold form and the base material of the pattern to allow expansion of the base material without exerting any pressure on the casting mold. Although such a process of fabricating the expendable mold did in part solve some of the deficiencies with respect to prior techniques, significant problems still exist with respect to the use of materials which have the propensity for violent expansion within the mold cavity, and can still result in mold spoilage. Additionally, the technique as described in this prior patent is difficult in operation to obtain the proper geometry and precision with respect to the mold form dimensional and surface finish characteristics. The inaccuracy with which the final expendable pattern is formed may result in unacceptable mold forms, thereby decreasing the yield of acceptable castings.

SUMMARY OF THE INVENTION

Based upon the foregoing, it is a primary object of the invention to provide a new and improved process and apparatus for creating an expendable pattern for complex metal castings which advantageously utilizes plastics materials which are structurally strong and relatively non-deformable, while avoiding the inherent deficiencies of the use of such materials. The ability to effectively use such plastics materials enable the fabrication of an expendable pattern which is structurally strong, not subject to deformation and yet can be easily removed from the generated mold form without causing mold spoilage.

It is another object of the invention to provide a method and apparatus for producing expendable patterns, wherein the expendable pattern is initially formed utilizing plastics materials which are subsequently replaced in the pattern to achieve high precision and ease of fabrication while eliminating the possibility of mold spoilage by expansion of plastic materials within the expendable pattern.

Another object of the invention is to provide a new and improved method for fabricating an expendable pattern to allow a higher yield of acceptable mold forms to be obtained for use in complex metal castings.

A further object of the invention is to provide a method of producing expendable patterns of high structural integrity to allow the fabrication of large patterns which will not be so susceptible to deformation upon subsequent handling and use.

Yet another object of the invention is to provide a method for the fabrication of expendable patterns, wherein plastic components are used to manufacture a plastic model pattern, and such components are subsequently eliminated such that a single highly precise wax pattern will be obtained for fabrication of a mold form.

Another object of the invention is to provide a process and apparatus for fabricating expendable patterns, wherein a soluble wax die is temperature controlled for the thermal characteristics and constraints of the wax to greatly reduce inaccuracies or other deficiencies in the pattern so as to greatly increase the yield of acceptable patterns for use in mold formation.

Yet another object of the invention is to provide the process and apparatus for fabricating an expendable pattern which allows adequate control of the flow of wax materials used in the fabrication process to avoid imperfections in the pattern formed thereby.

These and other objects of the invention are accomplished by a new process for fabricating a complex expendable pattern for the production of complex mold used to form complex metal castings. The process of the invention may be termed the "Stanciu Process", and generally comprises the steps of forming a plastic pattern by suitable molding techniques, or for complex and intricate patterns by the formation of individual plastic components which may be assembled to form a final plastic pattern. The plastic pattern is positioned or assembled in an assembly fixture or a soluble wax die, and a soluble wax may then be injected in and around the plastic pattern within the soluble die by use of a suitable injection molding apparatus. The composite structure comprising the soluble wax and plastic pattern may then be immersed into a bath or exposed to a solvent fluid which will dissolve the plastic materials. The solvent is such that although it will dissolve the plastic, it will not attack the soluble wax portion of the pattern, and will thereby leave a solid soluble mold component or components having the required precise dimensional and surface finish characteristics of the initial plastic pattern. Subsequent to this, an expandable wax pattern may be obtained by injection of a suitable wax material, such as an insoluble wax, into the cavity formed upon removal of the plastic pattern. The composite soluble and insoluble wax pattern formed may then be subjected to a suitable solvent to dissolve the soluble wax therefrom, leaving an expendable wax pattern having the precise dimensional and surface finish characteristics to produce complex metal castings by the investment casting process.

The process and apparatus used to fabricate the expendable patterns in this manner avoid inherent deficiencies relating to the fabrication of such patterns simply using a low melting point wax, and allow complex and intricate patterns to be formed in an expedient and cost effective manner while reducing scrap patterns. The initial use of plastic components to manufacture complex plastic patterns allows the advantages of these materials to be obtained while the deficiencies thereof are thereafter eliminated. The "Stanciu Process" enables the fabrication of complex and intricate patterns and/or large patterns in an efficient manner while avoiding the use of individual soluble wax inserts which are subject to shrinkage and distortion. The apparatus usable in the formation of the expendable pattern as described herein facilitates injection of the soluble wax in and around the plastic model pattern by insuring adequate control of the temperature of the die to avoid any deficiencies in the subsequently formed cavity upon dissolving the plastic materials. The apparatus additionally allows injection of the soluble wax in and around the plastic model pattern so as not to damage the formed mold cavity by adequately controlling the flow of wax into the die and the application of appropriate nozzle pressure in the injection process. Upon dissolving the plastic from within the composite soluble wax/plastic pattern, a mold cavity is formed having the precise dimensional characteristics of the plastic pattern without any destruction, degradation or deterioration thereof. The same apparatus may be used in the injection of the insoluble wax into the mold cavity formed in the soluble wax to again insure proper formation of the wax pattern to be subsequently used in the investment casting or other mold forming process.

BRIEF DESCRIPTION OF THE DRAWINGS

The objects and advantages of the invention will become apparent upon a further reading of the detailed description of the invention in conjunction with the drawings wherein.

DETAILED DESCRIPTION OF THE INVENTION

Figure 2:
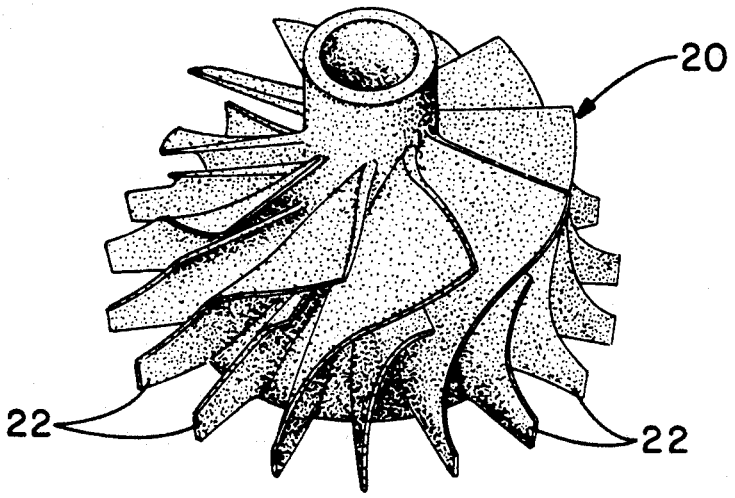
FIG. 2 is a perspective view of another complex and intricate pattern formed by the process of the invention to be used in an investment casting or other mold forming process for complex and precise metal castings.
Figure 1:
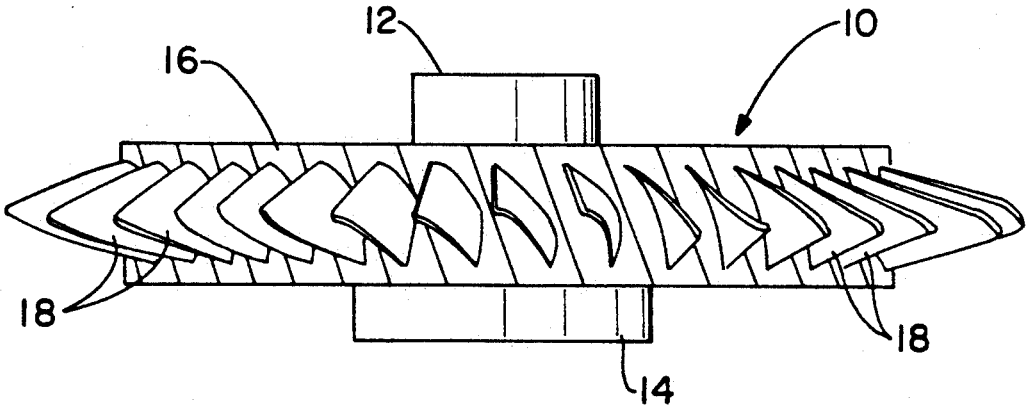
FIG. 1 is a side elevational view of a complex and intricate pattern which may be formed by the process of the invention.

Turning now to FIG. 1, there is shown an expendable pattern of a rotatable turbine wheel, which may be used to form a mold for use in an investment casting process by which intricate and precise metal castings may be produced. The pattern of the turbine wheel 10 may be constructed of a wax or other suitable pattern material, but is conveniently and cost effectively constructed of a plastic material. The turbine wheel pattern 10 is seen to comprise hub portions 12 and 14 which are coupled to integral wheel portions extending radially outward from the hub portions 12 and 14 respectively. On the outer periphery of the wheel portion 16, there may be provided a continuous and regular series of turbine blades 18 designed to have a predetermined shape and pitch for a desired purpose. In many instances, the turbine blades 18 will have a uniform pitch between blades with all blades bent in a single circumferential direction, wherein adjacent blades will overlap in the circumferential direction as seen in FIG. 1. The turbine wheel pattern 10 may be constructed by the molding of individual wax components, which may then be fused or otherwise secured to one another to form the final pattern. Alternatively the turbine wheel pattern 10 may be produced as a two piece hub and blade complex, wherein two tub halves are meshed together to form the complete wheel pattern with the adjacent turbine air foil blades 18 in the overlapping configuration shown. Such a wheel pattern and this method of construction is described in U.S. Pat. No. 4,139,046, which shows production of such a pattern by constructing the pattern of plastic. It should be recognized that constructing a complex pattern of the type as seen in FIG. 1 is made easier and more cost effectively by utilizing plastic materials rather than attempting to construct such a pattern out of wax or other suitable pattern material. It should also be recognized that the patterns used in investment casting, or other processes may be significantly more complex than that shown in FIG. 1, as represented by the impeller 20 shown in FIG. 2, which includes vane segments 22 having extremely complex configurations and dimensional characteristics which vary in the circumferential direction of the pattern. The use of plastic materials in the construction of an expendable pattern for use in casting processes allows fabrication of high production quality molds having the desired dimensional and surface finish characteristics necessary in the casting of complex articles. It should thus be apparent that the particular plastic model used in the process of fabricating a mold form herein, may vary to a great extent and be utilized to produce a mold form for casting of a wide variety of metal objects. For example, a plastic model similar to that shown in FIG. 1 may be used to form a turbine nozzle wheel pattern which includes inner and outer shrouds positioned relative to the air foil blades thereof, or individual blade and vane segments, impellers or a variety of other complex precision metal objects having air foil blades. The plastic model may be constructed by any suitable technique including securing a plurality of components together to form the final pattern or molding the final pattern in the desired form. The plastic models produced are easier to handle, of higher production quality, and allow more cost effective fabrication of a desired mold form to be used in casting metal objects. It is also reiterated that the use of plastics provides a structurally strong pattern which allows easy fabrication into clusters for preparation of patterns of substantial dimension as is many times desired.

Figure 3:
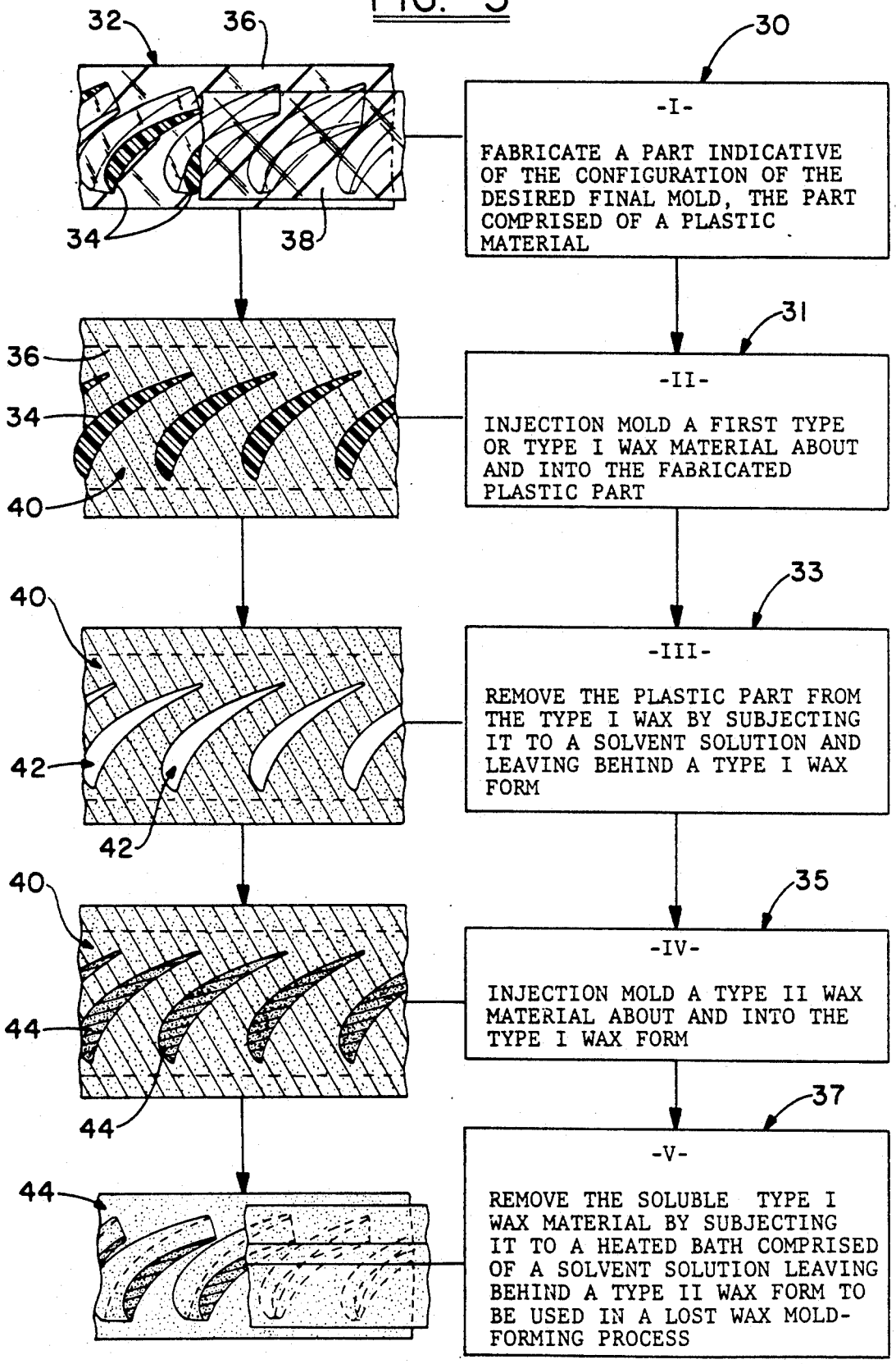
FIG. 3 is a generally schematic partial side elevational view of the individual steps in the process of the invention in conjunction with blocked diagrams of the process steps.

Turning now to FIG. 3, the process of the invention will be described with reference to a particular preferred embodiment thereof. In FIG. 3, step I of the process is shown at 30 which corresponds to the partial side elevation view of the pattern to be fabricated during the process of fabrication. The first step of the process comprises forming a plastic model pattern 32 similar to that shown in FIGS. 1 and 2, such that the plastic pattern 32 is of a desired configuration corresponding to the shape of the final mold which is to be used in a metal casting process. As previously mentioned, the expendable pattern 32 may comprise vane or blade portions 34 which may be intricate in their geometry, spacing or relationship to adjacent blade segments. Surrounding the vane segments 34 may be an inner shroud 36 and a surrounding outer shroud 38 as an example. The pattern 32 is comprised of a plastic material such as a synthetic thermoplastic resinous material. The plastic material may be selected from a large group of thermoplastic resins well known for use in constructing expendable patterns, such as polystyrene, polyvinylchloride, polyvinylidene chloride, vinyl chloride vinyl acetate copolymer, polymethylmethacrylate and polyalkyl acrylates and copolymers thereof with acrylonitrile, styrene, vinyl chloride, vinylidene chloride and the like. A plastic material such as polystyrene may be most desirable due to its availability, cost, ease of fabrication and strength.

Once the plastic pattern is fabricated in a desired configuration, the entire plastic pattern will be positioned within a molding die of a typical injection molding apparatus as an example. Step II of the process of the invention then comprises the injection molding of a first type or Type I wax as seen in FIG. 3 at 31, which may be a soluble wax material 40 around the pattern 32 so as to completely encompass the plastic pattern 32 therein. As seen in step II at 31 in FIG. 3, corresponding to a cross-sectional view of the plastic model pattern 32 at the location of the blades or vanes 34, it is seen that the Type I or soluble wax 40 will be injected into and around the entire plastic pattern 32 without the formation of voids or the like within the soluble wax material 40. It should also be understood that other suitable soluble solids may be utilized in the practice of the invention. Also, as will be described in more detail hereinafter, the step of injecting a soluble material into and about the plastic model pattern is critical to insure proper subsequent formation of an expendable pattern to be used in the metal casting process. As the soluble wax material is designed to completely encase the plastic pattern model 32, it is essential to avoid the creation of voids or other disconformities in the soluble wax material, and the process and apparatus for proper injection of the soluble wax material must be capable of such performance. A suitable apparatus for injection of the soluble wax material about the plastic pattern model is shown and described in U.S. Pat. No. 4,274,823, which is hereby incorporated herein by reference, and allows continuous control relating to wax flow and pressure occurring in a molding cycle so as to insure proper injection of the soluble wax material 40.

Once the plastic model pattern 32 has been fully encased within the soluble wax material 40, step III of the process as shown at 33 comprises dissolving the plastic material from the soluble wax mold in which it is encased. As previously mentioned, a plastic model pattern has been utilized as the expendable pattern for developing a mold form for use in metal casting processes. The plastic model pattern has been removed from the formed mold by means of a heating cycle in which the entire mold form including expendable pattern is heated to a degree to cause the plastic material to melt, wherein the flowable plastic material was then removed from the mold to yield a cavity representative of the metal part to be cast. As the temperature at which the plastic materials became flowable is relatively narrow, a good possibility existed that upon heating of the plastic pattern model, flashing of the plastic material from its solid phase to a gaseous phase may occur. In many instances, this would result in mold spoilage by deformation or fracturing of the mold form due to the violent expansion of such gases therein. In the "Stanciu Process" as described herein, a plastic pattern model 32 is dissolved from the soluble wax form in which it has been encased to form a cavity having the exact dimensional and tolerance characteristics as the plastic model pattern. As seen at 33 of FIG. 3 in step III, the plastics material is removed or leached from the assembly, to provide a cavity 42 within the soluble wax form 40 having the exact characteristics of the plastic model pattern 32. Depending upon the particular type of plastics material utilized to form the plastic model pattern 32, a suitable solvent may be utilized to dissolve the plastic material from the soluble wax form, without attacking the Type I soluble wax itself. As merely an example, for a polystyrene plastic model pattern, a solvent bath comprising a solution of toluene and xylene has been found to dissolve the plastic model pattern 32 without attacking the soluble wax mold form as desired. The solvent usable to leach the plastic pattern will of course depend upon the particular type of plastic and suitable solvents are known to those of ordinary skill in the art.

Upon forming the cavity within the soluble wax form 40, step IV of the process, shown at 35, comprises the injection of a Type II material into the cavity spaces 42, which will essentially recreate the plastic model pattern within mold form 40, but of an expendable material other than plastic. As a preferred example, the Type II material may be an insoluble wax material which is injected into the cavity areas 42 by a suitable injection molding apparatus. As seen at 35 of FIG. 3, step IV, the insoluble wax material 44 is injected to fully fill the cavity created within the soluble wax form 40 upon leaching of the plastic material therefrom.

It should be recognized that in the steps of the process as previously described, after injection molding of the Type II insoluble wax or other material 44 into the cavity within the soluble wax form 40, there will be fabricated an expendable pattern having all of the advantages of utilizing a plastics material in the formation thereof, but eliminating the plastics material therefrom. As a final step V in the process to result in an expendable pattern having the desired close tolerance and surface finish characteristics, the soluble wax material is then leached from the composite structure as seen in step V at 37 of FIG. 3, by dissolving the soluble wax in a suitable solvent conventionally used with such soluble wax materials. Once the soluble wax material has been dissolved from the composite soluble/insoluble wax form, all that will remain will be the insoluble wax material forming the expendable pattern 44 which has the identical configuration to the original plastic model pattern 32 with which the process began. The expendable pattern 44 may then be utilized in a lost wax mold forming process, wherein once the mold form is fabricated, the wax material may be melted and removed from the mold form in the conventional manner.

Alternatively, it should be recognized that the Type I verses Type II materials may be the soluble verses insoluble wax materials as previously described, but also may comprise wax or other materials which exhibit differing melting temperature characteristics or the like. For example, the Type I wax form 40 may be replaced by a low melting point material, while the Type II insoluble wax form 44 may comprise a higher melting point material which will not be effected by a lower temperature heating cycle adapted to remove the low melting point material from the composite mold form as seen for example in step V of FIG. 3. Low melting point paraffin waxes may be used in this capacity with higher melting point wax compositions as an example. Other low melting point solids such as hydrogenated vegetable oils and saturated fatty acids or similar materials may be sufficient as the low melting point materials if desired. It is also contemplated by the invention that other combinations of Type I materials and Type II materials may be used in the process to achieve the same results in a similar manner.

It should be apparent that the process of the invention provides a new and improved fabrication process for expendable patterns which allows the benefits of utilizing plastic materials in the fabrication process to be gained while the deficiencies of these materials are eliminated. The resulting expendable pattern fabricated in the process alleviates the difficulties heretofore encountered in the use of plastics materials and allows the preparation of ceramic or other mold forms of high production quality and rate while reducing fracturing or mold form deterioration significantly.

Figure 4:
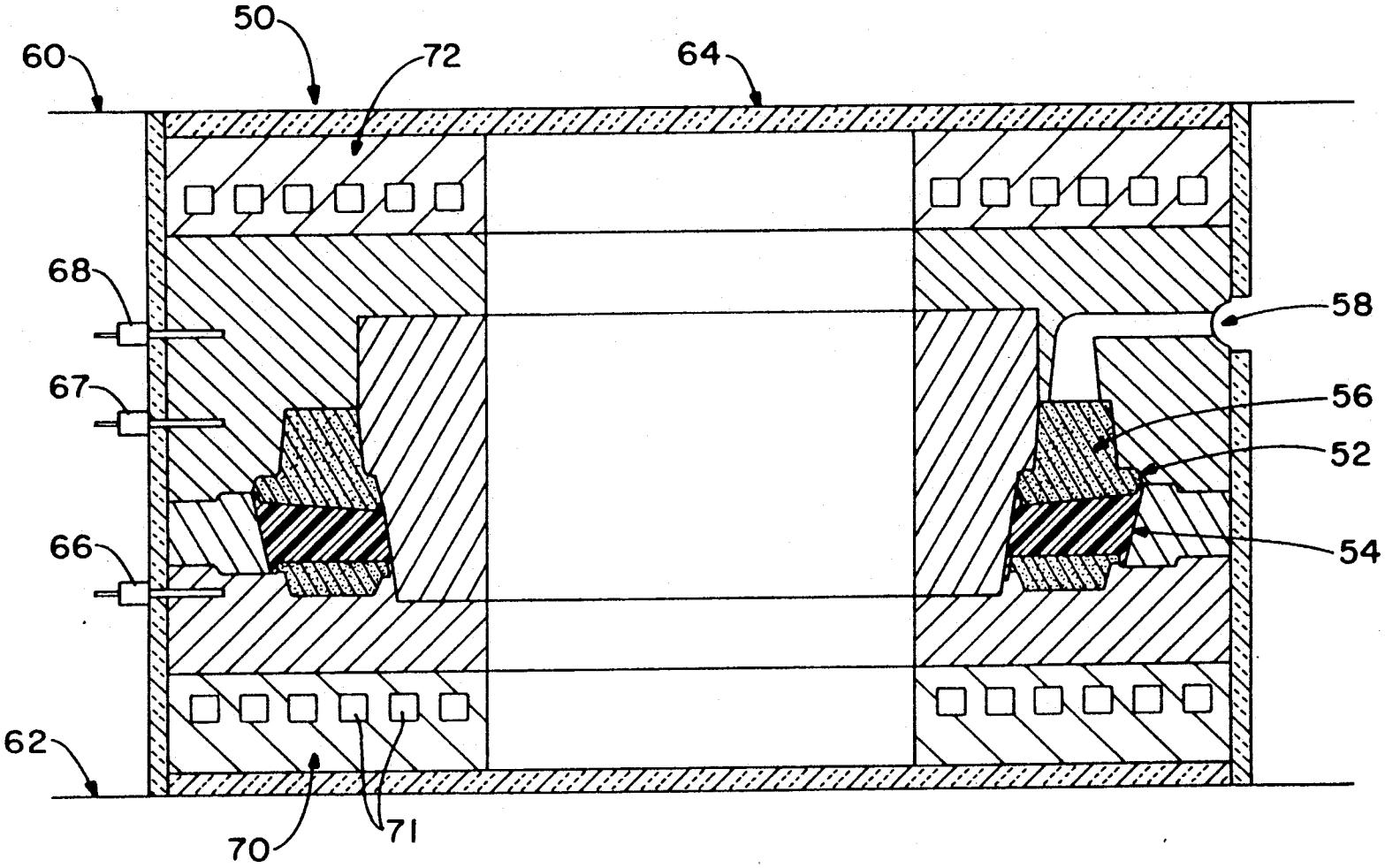
FIG. 4 shows a cross-sectional view of the die structure into which a plastic pattern may be positioned, and used for the injection of a soluble wax material in and around the plastic pattern in the process of the invention.

Turning now to FIG. 4, the apparatus usable in the critical step of surrounding a plastic model pattern with a first type of expendable material such as a soluble wax material is shown. As previously mentioned, the plastic model pattern may be situated within an injection die structure to allow injection of the soluble wax material in and around the plastic pattern as mentioned. An injection apparatus which is suitable for facilitating proper injection and formation of the composite plastic pattern and soluble mold form is shown in U.S. Pat. No. 4,274,823 which has been incorporated herein by reference. In such an apparatus, a liquified wax material is supplied to an injection nozzle which is in turn connected to a molding die 50, of which an example is shown in FIG. 4. The die 50 as seen in FIG. 4 is shown to include a mold cavity 52 usable in the formation of a turbine wheel pattern similar to that shown in FIG. 1. Within the generally circular cavity 52, is positioned the plastic model pattern for the turbine wheel, of which several air foil blades 54 are shown. Within the mold cavity 52 above the position of the plastic model component is a riser section 56 which is in turn coupled to an injection nozzle port 58 into which a nozzle tip of the injection apparatus is positioned. The injection molding apparatus is adapted to provide an injection cycle sequence of operation to insure proper encasement of the plastic pattern 54 within the soluble wax or other material within die 50. The apparatus allows control of the injection process to insure proper filling of the void regions within the soluble die cavity including around plastic components of the plastic pattern 54. Upon filling of the cavity 52 with a suitable soluble wax material or the like, the apparatus maintains sufficient pressure upon the wax to provide a high quality of cure for the wax pattern formed in cavity 52.

It has also been found that in the step of encasing the plastic model pattern with a soluble wax, the necessity for eliminating any voids or cavities within the composite soluble wax/plastic structure is critical. To insure proper injection and solidification of a soluble wax, it may be necessary to slowly cool the die structure 50 in accordance with the injection cycle for optimum results. In the die structure as shown in FIG.4, the die 50 may be situated between top and bottom platens 60 and 62 respectively of the injection molding apparatus. A layer of insulation 64 may be formed around the entire exterior of the die 50 to insure proper control of temperatures within the die itself. Upon injection of a soluble wax material into the die cavity 52, it was found that slowly cooling the injected wax from the bottom of the die 50 upwardly resulted in proper fabrication of the soluble wax/plastic pattern composite structure. The mold die 50 therefore includes a plurality of temperature sensors 66, 67 and 68 respectively, wherein sensor 66 is adapted to measure the temperature of the die at a lower region thereof, sensor 67 a mid portion thereof and sensor 68 a top portion of the die assembly. The die structure 50 also includes a bottom heat transfer unit 70, which may comprise a series of fluid circulation channels 71 in which a cooling or heating fluid may be continuously or selectively circulated to maintain the bottom portion of the die structure at the desired temperature. Monitoring of the temperature of the die structure at a bottom portion is accomplished by sensor 66, and adjustments to the operation of the bottom heat transfer unit are made accordingly. Similarly, a top heat transfer unit 72 is provided to affect proper temperature control at the top portion of the die structure 50, such that the temperature upon cooling or heating of the die structure may be effectively controlled and monitored. The proper injection parameters are chosen for a particular molding die to effectively control an injection cycle and solidification. cycle for proper fabrication of the wax mold form.

Figure 5:
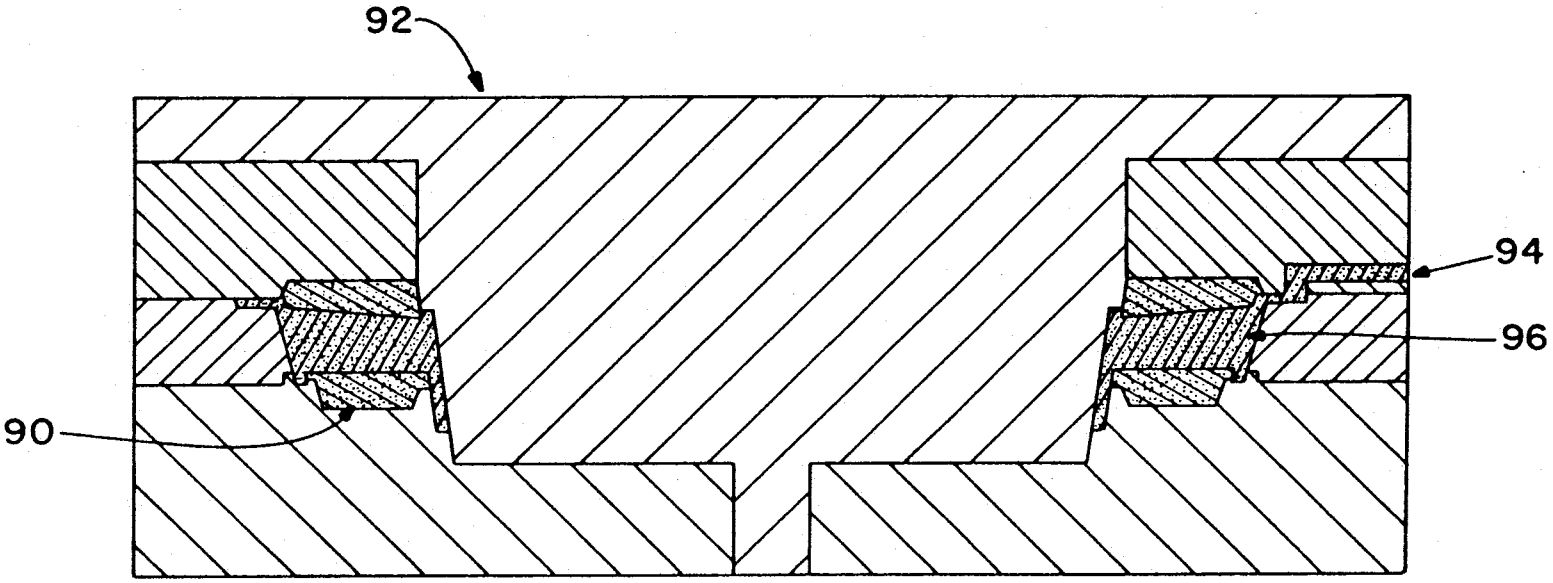
FIG. 5 is a cross-sectional view of a pattern die used in the injection of an insoluble wax material into the mold cavity formed in the soluble wax pattern.
Figure 6:
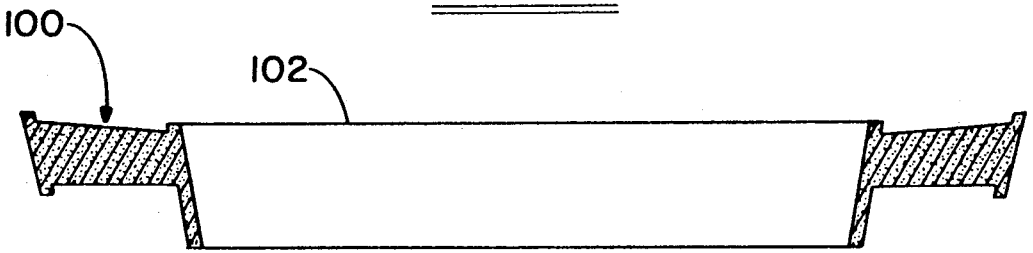
FIG. 6 is a cross-sectional view of final wax pattern generated by the process of the invention which may be used in a mold forming process associated with complex and precise metal casting techniques.

Once the composite soluble wax/plastic model pattern is formed, leaching of the plastic therefrom may be performed immediately thereafter. The composite structure is immersed within a bath of a suitable solvent as previously described until the plastic model pattern is fully dissolved. The remaining soluble wax mold form will have defined therein, a cavity corresponding to the configuration of the plastic model pattern. This mold form may then be prepared for wax injection, which will be described with reference to FIG. 5. The soluble wax mold form produced in the process as previously described, and labeled 90 in FIG. 5, is positioned within a cavity of an injection molding die 92. Precise control over injection parameters such as the flow of wax, pressure on the wax and the like ensure proper formation of the desired pattern of insoluble material. As seen in FIG.5, an injection port 94 may be coupled to an injection nozzle (not shown) and a supply of insoluble wax 96 injected into the cavity within soluble wax form 90. The pattern form by the insoluble material 96 injected into mold form 90 is a recreation of the plastic model pattern without any plastic components. After the step of injecting the insoluble wax material into the mold form cavity, a composite soluble/insoluble structure results, as seen in FIG. 5. Leaching of the soluble wax material may be performed immediately after injection of the insoluble wax, wherein the soluble material is removed from the insoluble wax by placing it in a water and citric acid bath resulting in an insoluble wax pattern 100 as seen in FIG. 6.

It should be recognized from the foregoing description of the preferred embodiments of the invention, that the process and apparatus of the invention allow fabrication of an expendable pattern for use in investment casting or other lost wax mold forming process. The "Stanciu Process" as described herein is applicable in the fabrication of any expendable pattern which conventionally has utilized plastic components therein, so as to attain the advantages of the use of such materials, but eliminating the disadvantages thereof. The resultant expendable pattern formed in the process will not have any plastic components therein, and will thus be less likely to cause cracking or deterioration of a ceramic mold prepared therewith resulting in high product quality at lower costs. Although particular preferred embodiments of the invention have been shown and described herein, various modifications or variations in the process or apparatus are possible and may be made without departing from the spirit and scope of the invention as defined in the appended claims.

What is claimed is:

1. The process to form a mold from an expendable pattern, used to produce a complex metal part in a metal casting process, comprising the steps of:

forming a pattern having predetermined dimensional and surface tolerances corresponding substantially to the dimensional and surface tolerances of a desired completed metal part to be produced in a metal casting process, said pattern being formed of a first type of soluble material and having at least a portion thereof formed from a thermoplastic material, encasing said pattern within a first type of wax material, dissolving said pattern from said first type of wax material to define a mold cavity in said first type of wax material corresponding to said pattern and having said predetermined dimensional and surface tolerances of said pattern, introducing a second type of wax material into said cavity formed in said first type of wax material so as to substantially recreate said pattern within said first type of wax material without any plastic portions therein, removing said first type of wax material by melting or dissolving the wax material to form a completed expendable pattern of said second type of wax material, said completed pattern having said predetermined dimensional and surface tolerances, and forming a mold from said completed expendable pattern into which a metal material will be introduced to produce a metal part in a metal casting process which has said predetermined dimensional and surface tolerances.

2. The process of claim 1, wherein, said step of dissolving said pattern from said type of wax material comprises exposing the first type of soluble material from which the pattern is made, including the at least one plastic portion to a solvent solution which will dissolve said first type of soluble material but will not dissolve said first type of wax material.

3. The process as in claim 1, wherein:

said step of encasing said pattern within said first type of wax material comprises injection molding said first type of wax material in and around said pattern so as to fully encase said pattern within said first type of wax material with at least a portion of said pattern being surrounded by said first type of wax material.

4. The process as in claim 1, wherein, said first type of wax material is of a type which may be melted and utilized in an injection molding process and subsequently will become solid at ambient temperature.

5. The process as in claim 1, wherein, said first type of wax material is a soluble wax, wherein in said step of removing said first type of wax material, said soluble wax is dissolved in a suitable solvent solution distinct from the solvent solution used to dissolve said first type of soluble material.

6. The process as in claim 1, wherein, the first type of wax material is a low melting point material, wherein said step of removing said first type of wax material comprises exposing said wax to sufficient heat to cause melting of the first type of wax material to form said expendable pattern, wherein said second type of wax mateiral will not melt when exposed to temperatures sufficient to melt said first type of wax mateiral.

7. The process of claim 1, wherein, said second type of wax material introduced into said cavity is an insoluble wax, and said step of removing said first type of wax material comprises dissolving said first type of wax material within a suitable solvent solution which will not attack said second type of wax material.

8. The process of claim 1, wherein, said second type of wax material introduced into said cavity is a higher melting point material than said first type of wax mateiral, and said step of removing said first type of wax material comprises heating of said first type of wax material to its melting point for removal thereof, wherein said heating will not cause deformation of said pattern formed of said higher melting point mateiral.

9. The process as in claim 1, wherein, said pattern is formed completely of a thermoplastic mateiral.

10. The process as in claim 1, wherein, said pattern having predetermined dimensional and surface tolerances includes at least one air foil blade, and said step of encasing said pattern within a first type of wax material includes encasing said at least one air foil blade fully within said first type of wax material such that said mold cavity defined upon dissolving of said pattern from said first type of wax material will include a cavity corresponding to said at least one air foil blade with said predetermined dimensional and surface tolerances.

11. The process as in claim 1, wherein, said step of dissolving said pattern from said first type of wax material produces a solid segment mold component, a plurality of which may be used to form a mold corresponding to said complex metal part to be cast.

12. The process as in claim 1, wherein, said pattern includes a plurality of air foil blades associated with the metal part to be cast, and said mold cavity formed in said first type of wax material upon dissolving of said pattern will include cavities corresponding to said plurality of air foil blades to form a complete expendable pattern of a metal part to be produced in a metal casting process.

13. The process of claim 1, wherein, said step of encasing said pattern within a first type of wax material comprises injecting said first type of wax material into an injection mold cavity about said pattern, and thereafter cooling said first type of wax mateiral from a bottom portion of said injection mold cavity upwardly until said first type of wax material is completely cooled.

14. A method of producing a pattern of heat disposable material for use in fabrication of a mold form to be used to produce a complex metal part by means of a metal casting process, comprising the steps of:

forming a first pattern which is configured to have predetermined dimensional and surface characteristics corresponding to a desired completed metal part to be cast, wherein said first pattern includes at least a portion constructed of a plastic material, injecting a soluble wax material around said first pattern so as to fully encase said first pattern within said soluble wax material, leaching said first pattern from said soluble wax material to define a cavity within said soluble wax material corresponding to the dimensional and surface characteristics of said first pattern, injecting an insoluble wax material into said cavity to form a second pattern of said insoluble wax material within said soluble wax material, said second pattern having said predetermined dimensional and surface characteristics, and leaching said soluble wax material from said insoluble wax material, whereby said second pattern is exposed for use in a metal casting process.

* * * * *